US005876150A

United States Patent [19]

Koleszar

[11] Patent Number: 5,876,150

[45] Date of Patent: Mar. 2, 1999

[54] SELF-RECOVERING GRADE CONTROL FEELER

[76] Inventor: William J. Koleszar, 3334 E. 20th St., Highland, Calif. 92346

[21] Appl. No.: 832,041

[22] Filed: Apr. 2, 1997

[51] Int. Cl.[6] ..... E01C 23/07

[52] U.S. Cl. ..... 404/84.2; 404/84.05

[58] Field of Search ..... 404/84.05, 84.1, 404/84.2, 84.8, 98

[56] References Cited

U.S. PATENT DOCUMENTS

| | | | |
|---|---|---|---|
| 3,363,524 | 1/1968 | Cantenacci | 425/64 |
| 3,564,986 | 2/1971 | Burgin | 404/84.2 |
| 3,636,833 | 1/1972 | Lowen et al. | 404/84.2 |
| 3,710,695 | 1/1973 | Miller et al. | 404/98 |
| 3,749,505 | 7/1973 | Miller et al. | 404/98 |
| 3,779,661 | 12/1973 | Godbersen | 404/72 |
| 3,779,662 | 12/1973 | Smith | 404/98 |
| 3,820,913 | 6/1974 | Miller et al. | 404/98 |
| 3,864,858 | 2/1975 | Rochfort | 404/98 |
| 3,890,055 | 6/1975 | Rochfort | 404/84.2 |
| 4,197,032 | 4/1980 | Miller | 404/98 |
| 4,319,859 | 3/1982 | Wise | 405/268 |
| 5,354,189 | 10/1994 | McKinnon | 425/64 |

*Primary Examiner*—Tamara L. Graysay
*Assistant Examiner*—Sunil Singh
*Attorney, Agent, or Firm*—Gene Scott-Patent Law & Venture Group

[57] ABSTRACT

A grade control feeler assembly provides a pair of spaced apart control line feelers mounted on a rotational hub such that when an obstacle such as a line stake is encountered a first feeler running in contact with the line is rotated by the obstacle. This results in the rotation, as well, of the second of the feelers into contact with the line. When the obstacle has been negotiated, a spring causes the feelers to rotate to their original positions without even a momentary loss of contact between the feeler assembly and the line.

6 Claims, 4 Drawing Sheets

SELF-RECOVERING GRADE CONTROL FEELER

BACKGROUND OF THE INVENTION

1. Field of the Invention

This invention relates generally to control devices for directing the motion of a moving equipment, and more particularly to a line feeler assembly for adjusting the height of concrete poured from a moving extruder.

2. Description of Related Art

The following art defines the present state of this field:

Catenacci, U.S. Pat. No. 3,363,524 describes a curb extruding machine.

Lowen et al., U.S. Pat. No. 3,636,833 describes how concrete may be laid to a surface by a datum wire extending e.g. over rough ground by a machine including a mobile carriage with a concrete hopper feeding concrete between slip forms in a controlled fashion using a gate vertically movable in dependence on the movement of sensing devices touching the wire.

Miller et al., U.S. Pat. No. 3,710,695 describes the main frame of a construction machine that is supported upon two pairs of crawler tractors through a five point suspension using four hydraulic rams, two of which cooperate with one pair of tractors and two of which cooperate with the other pair of tractors through a walking beam.

Miller et al., U.S. Pat. No. 3,749,505 describes a machine for handling, conveying, compacting and distributing formable material such as concrete upon or along a work location in the desired grade, slope and directional configuration defined by an external reference extending along the path of travel.

Godbersen, U.S. Pat. No. 3,779,661 describes machine and method that provides for the simultaneous and continuos preparing of a graded surface and the slip forming of a curb and gutter or a sidewalk on the prepared surface.

Smith, U.S. Pat. No. 3,779,662 describes an improved curb slip form apparatus for forming a predetermined, formed configuration of a concrete material of the like on a surface generally along a predetermined survey line, having a form member which is pivotally connected to a support frame, the formed configuration being extruded from the form member, in an operating position of the form member, in an operating position of the form member and in a driven position of the support frame.

Miller et al., U.S. Pat. No. 3,820,913 describes a self-propelled curb and gutter forming machine mounted on continuous traction devices and drawing a mold for the curb and gutter between the traction tread devices.

Rochfort, U.S. Pat. No. 3,864,858 describes a concrete laying machine that includes a frame having a rear portion adjustable or variable in width and carried by a pair of rear tandem wheel supporting assemblies.

Rochfort, U.S. Pat. No. 3,890,055 describes a machine for laying a continuos run of concrete of constant section such as roadway curbing. The machine includes a body portion having a chamber adapted to receive concrete and discharge it rearwardly through an outlet to a mould adapted to shape the discharged concrete to a desired cross-section.

Miller, U.S. Pat. No. 4,197,032 describes an apparatus for concurrently preparing a ground surface and forming a continuos strip of paving material thereon, and which is characterized by the ability to simultaneously grade the ground surface substantially coextensively with the successive slip forming of the pavement material.

Wise, U.S. Pat. No. 4,319,859 describes a self-propelled apparatus for extruding and forming a substantially U-shaped concrete lining within a previously dug ditch and including means for accurately controlling the slope or grade of the interior bottom surface of the lining.

McKinnon, U.S. Pat. No. 5,354,189 describes a manually operable and steerable curb extrusion device for extruding curb, barrier, wall, gutter or the like from concrete, cement or some other moldable building material. The curb extrusion device has a segmented vibrating hopper into which building materials are placed to fall onto two tapered counter rotating vibrating augers which compact and force the building material through and extrusion mold where it is shaped before extrusion.

The prior art teaches the use of a wire for directing the steering and grade control servomechanisms of a moving concrete extruder. The prior art teaches a grade control feeler for cooperation with the wire in determining changes in extruding operation. However, the prior art does not teach a solution to the problem of overcoming obstacles in the path of the wire, nor of overcoming the expense of special overhang-type stakes and the labor required for their use. The present invention overcomes these problems and provides further related advantages as described in the following summary.

SUMMARY OF THE INVENTION

The present invention teaches certain benefits in construction and use which give rise to the objectives described below.

The present invention provides a grade control feeler assembly having a pair of spaced part control line feelers mounted on a rotational hub such that when an obstacle such as a line stake is encountered a first feeler running in contact with the line is rotated by the obstacle. This results in the rotation, as well, of the second of the feelers into contact with the line. When the obstacle has been negotiated, a spring causes the feelers to rotate to their original positions without even a momentary loss of contact between the feeler assembly and the line.

A primary objective of the present invention is to provide a grading line feeler assembly that enables the grading line to be strung along simple vertical stakes providing the advantage of simple, quick and inexpensive installation of the stakes.

Another objective of the present invention is to provide such a feeler assembly that, due to a rotatable two feeler construction, is able to negotiate around stakes of any type, including very rough stakes such as a tree limb or piece of construction site scrap lumber.

A further objective of the present invention is to provide a feeler assembly having feelers, that because of their shape, are able to move away from and recover back into contact with a grading line with great facility.

A still further objective of the present invention is to provide such a feeler assembly, that because of a two piece construction, that is able to sustain a side blow without being bent or destroyed and without damage to a grade sensor and sensor arm to which the feeler assembly is mounted.

Other features and advantages of the present invention will become apparent from the following more detailed description, taken in conjunction with the accompanying drawings, which illustrate, by way of example, the principles of the invention.

BRIEF DESCRIPTION OF THE DRAWING

The accompanying drawings illustrate the present invention. In such drawings.

DETAILED DESCRIPTION OF THE INVENTION

The above described drawing figures illustrate the invention, a grade follower device. Such grade follower devices are well known in the art as they are used on mobile equipment such as concrete extruding machines (not shown) for forming continuous curbs and other structures. The invention is described in relation to such a concrete extruding machine, but it is noted that such use is only one specific example of the application of the present invention. A grade sensor 10, such as model SB104A, Remote Proportional Grade/Steering Sensor, manufactured and made commercially available by the Sundstrand Mobile Controls Unit of the Sundstrand Corporation of Minneapolis, Minn., is used for converting physical position changes into appropriate electrical signals for controlling associated servomechanisms on board the extruding machine. In this manner concrete flow rate and dispatch height is controlled as the machine moves along the ground on a path which is maintained in parallel to a previously strung grading control line 20.

Grading control lines 20 are strung by surveyors in accordance with a construction plan and, by their elevational position and changes thereof along their course, provide the necessary grading information to the extruding machine. Interconnection between the grade sensor 10 and the grading line 20 is made via a grade follower device, shown as 30A in FIG. 5, the prior art, and 30B in FIGS. 1–4, the present invention.

Figure 5:
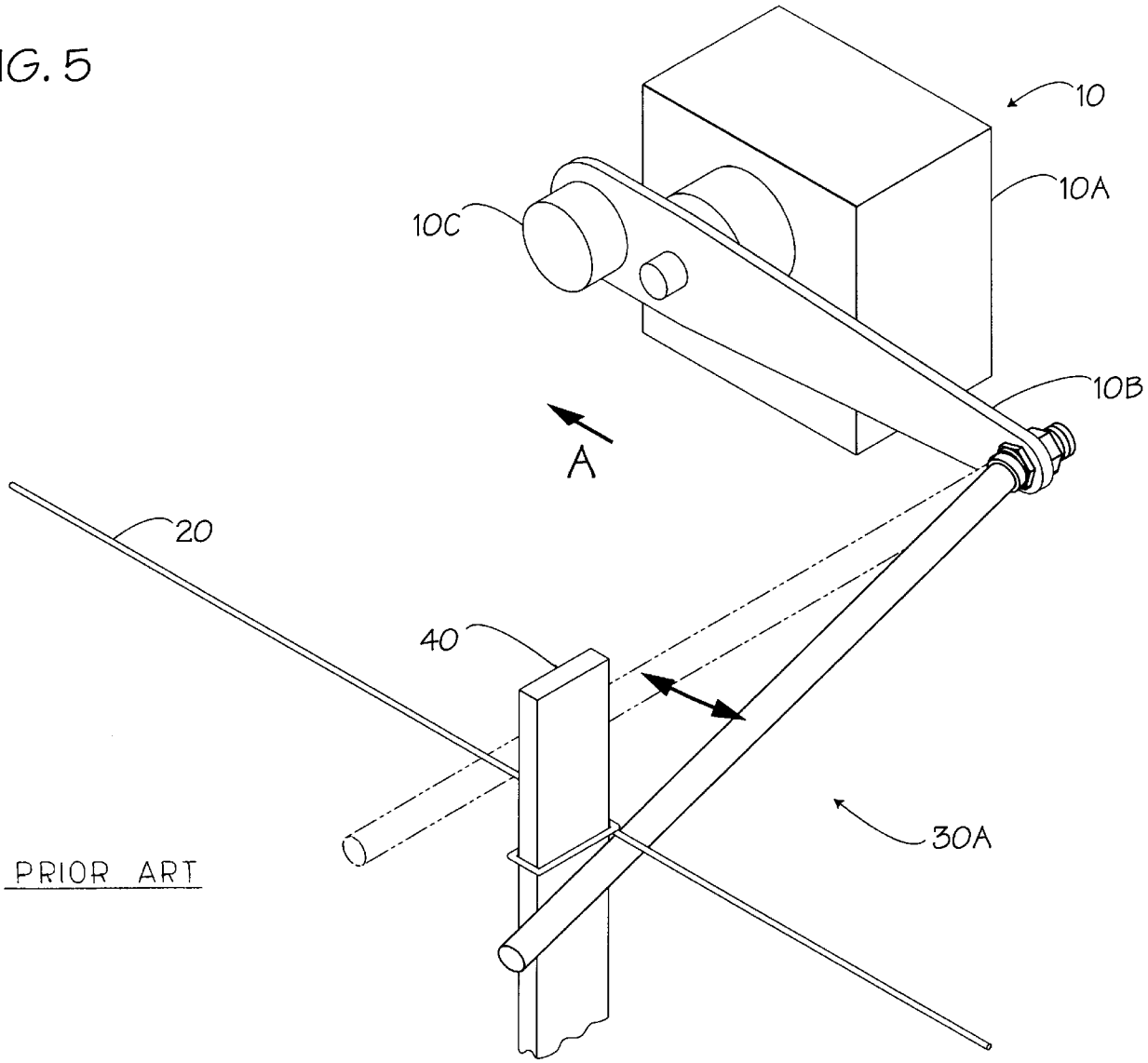
FIG. 5 PRIOR ART
FIG. 5 is a perspective view of a prior art device.

As shown in FIG. 5, the prior art teaches a grade sensor 10, such as that produced by the Sundstrand company. The grade sensor 10 comprises a grade sensor box 10A, housing appropriate circuitry (not shown), and a grade sensor arm 10B rotationally mounted on the exterior of the sensor box 10A. The sensor arm 10B extends predominantly to one side of the box 10A. As the arm 10B rotates, an electrical circuit element in the sensor circuitry, such as a potentiometer, is caused to change its electrical value. This value change enables the circuitry to produce appropriate signals for controlling the extruder. The grade follower 30A is mounted to, and extends from one end of the sensor arm 10B. The grade follower 30A is positioned so as to maintain contact with the grading line 20. In the setup shown in FIG. 5, the grade follower 30A is placed below the grading line 20. A counterweight 10C is mounted on the sensor arm 10B in order to urge the sensor arm 10B, and thus the grade follower 30A to maintain contact with the grading line 20 by rotating the sensor arm 10B as necessary. In the present case, the grade follower 30A tends to move upward to maintain contact with the grading line 20. Alternately, the grade follower 30A could be weighted so as to cause the grade follower 30A to tend to drop so as to allow the grade follower 30A to maintain contact with the grading line 20 from above it. In the present descriptions we show how the invention operates with the grade follower 30 positioned below the grading line 20, however the principle of operation is identical when considering the reverse case. In FIG. 5, the grade follower 30A of the prior art is spring mounted on the sensor arm 10B. As the grade follower 30A moves from left to right, as shown by arrow "A", when it encounter an obstruction, such as the stake 40 shown, the grade follower 30A is forced to withdraw from the obstruction, eventually loosing contact with the grading line 20 for a moment as the grade follower 30A passes the obstruction. In this case the sensor arm 10B will naturally move upwardly so that when the grade follower 30A returns to its original position after passing the obstruction, the grade follower 30A may be too high to reestablish itself under the grading line 20. This sort of event is of major concern in the laying of concrete as a continuous process. Whenever the grade follower 30A looses contact with the grading line 20, the poured concrete contains flaws in it which are costly to correct. Also, time is lost in starting-up the process again when a stoppage occurs. Even if the grade follower 30A does re-catch below the grading line 20 when it returns a small flaw in the poured concrete usually occurs due to the fact that the grade follower 30A is out of contact with the grading line 20 for a small amount of time. In order to avoid such problems, the prior art approach is to support the grading line 20 with special stake assemblies (not shown) having a vertical arm fixed into the earth, and a horizontal arm extending toward the curb and holding the grading line 20 at its end. Such special stakes are costly, and redundant, in that surveyor's stakes usually already exist along the required path.

Figure 1:
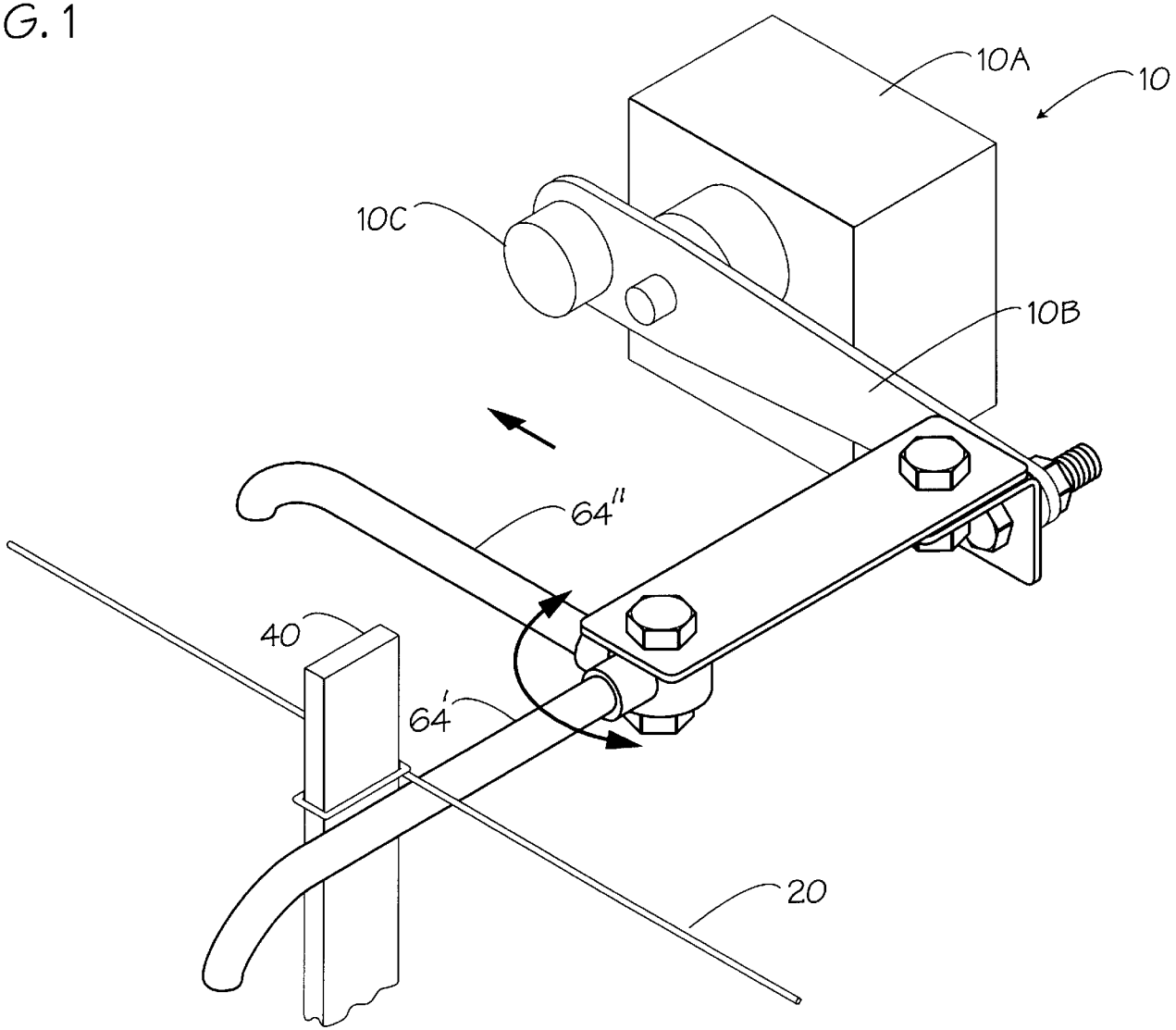
FIG. 1 is a perspective view of the preferred embodiment of the present invention shown in a normal position during use.
Figure 2:
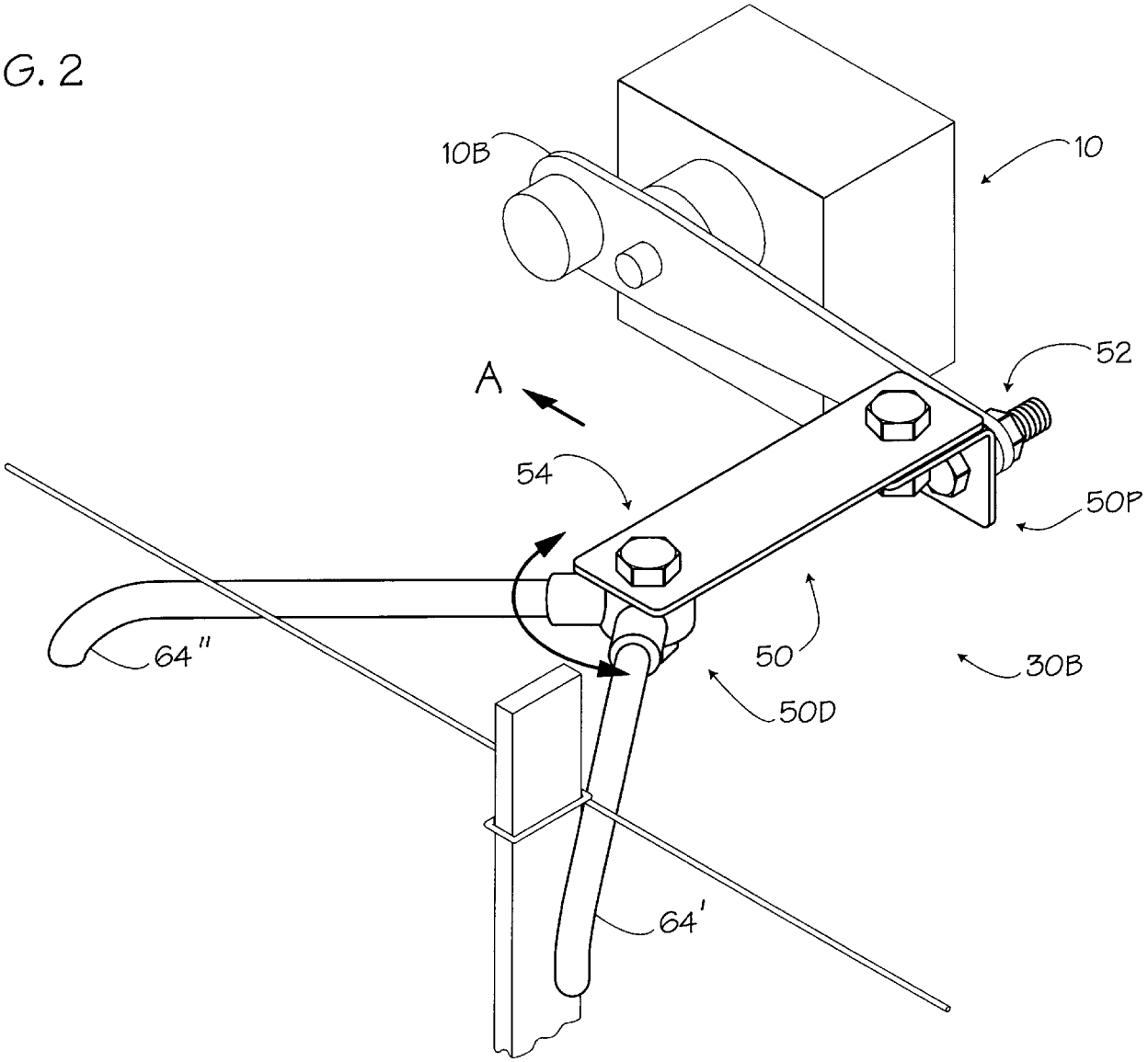
FIG. 2 is a view similar to that of FIG. 1 showing the manner in which the invention moves around an obstacle.
Figure 3:
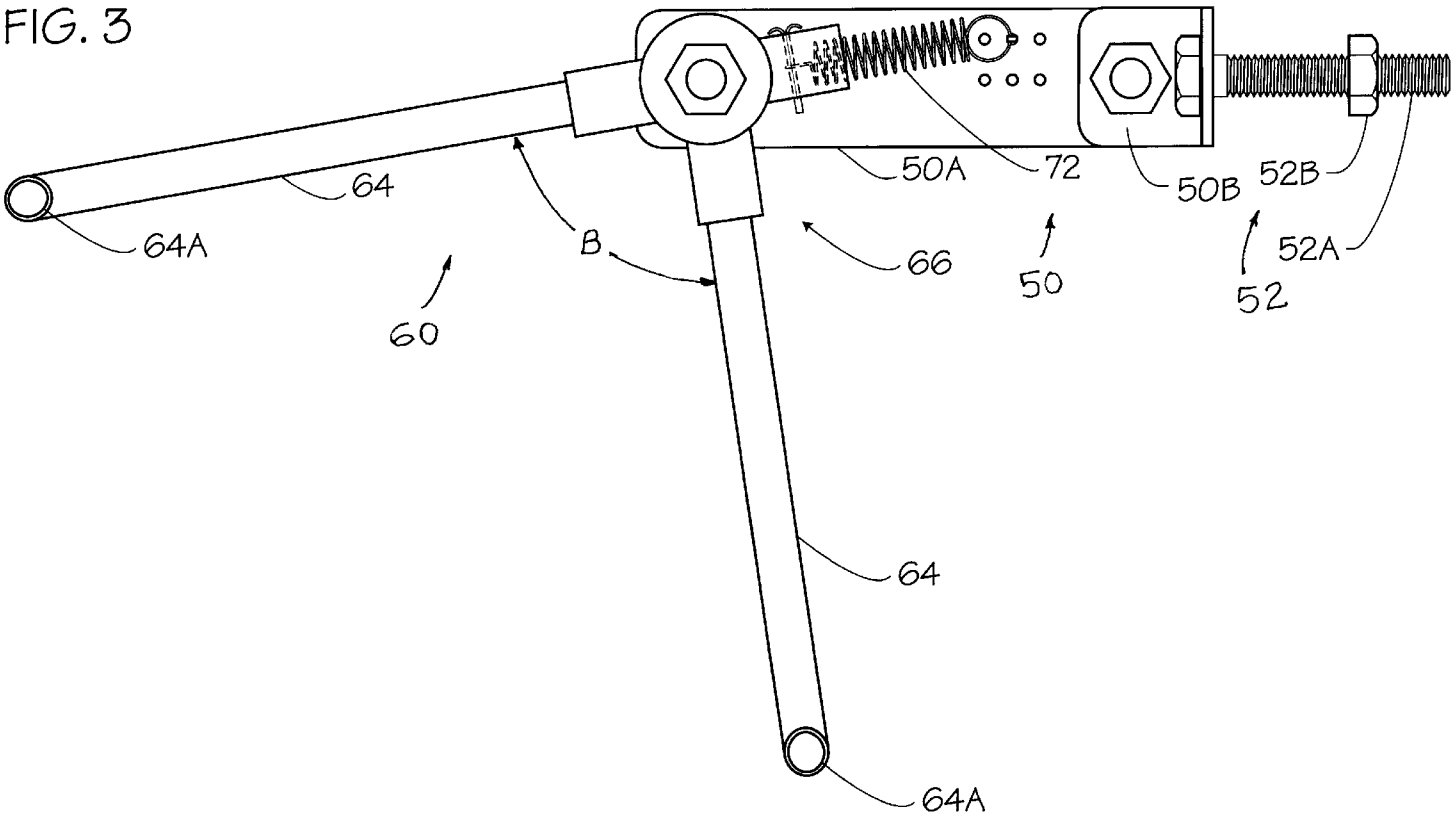
FIG. 3 is a bottom plan view thereof.
Figure 4:
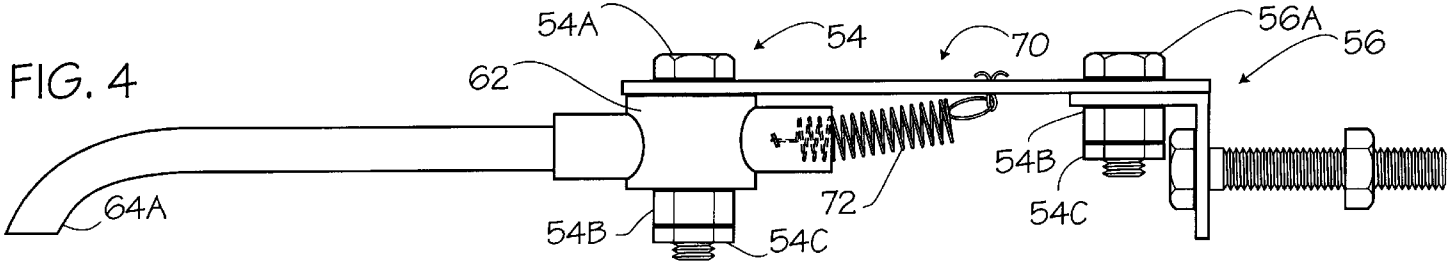
FIG. 4 is a side elevational view thereof.

The present invention grade follower 30B, as shown in FIGS. 1–4, provides a bracket 50 having a bracket mounting means 52 at a proximal end 50P for attachment of the follower to the grade sensor arm 10B which, in turn, is mounted to the grade sensor 10 on one side of the moving equipment (not shown). This mounting approach is not different from that of the prior art previously described. It also provides a hub mounting means 54 at a distal end 50D of the bracket 50. The bracket mounting means 52 is preferably a common bolt 52A and a nut 52B as shown in the figures. The hub mounting means 54 is preferably a further common bolt 54A and a nut 54B. A locking nut 54C is used to enable the positioning of the nut 54B at a selected location on the bolt 54A. The bracket 50 also may provide a means for rotation 56 of the bracket about the bracket mounting means 52 when acted upon by a side force greater than a selected magnitude. This enables the bracket 50 to accommodate a side blow without being bent or possibly destroyed, i.e., the means for rotation 56 allows the bracket 50 to rotate away from an obstruction that strikes it along one side. This, of course, should not normally occur, but may occur accidentally. The means for rotation 56 includes separating the bracket 50 into two portions 50A and 50B as shown in FIGS. 3 and 4, and interconnecting the two portions 50A and 50B with bolt 56A, an a second set of nuts 54B and 54C. The purpose of this construction will become clear as the function of the invention is described below.

A feeler assembly 60 provides a feeler hub 62 rotationally engaged on the hub mounting means 54 and a pair of line feelers 64 secured in radial positions on the feeler hub 62 and set with an angle "B" between them, preferably a 90 degree angle or an acute angle slightly less than 90 degrees. The line feelers are preferably mounted in a hollow tubular stub means 66 for frictionally mounting the line feelers 64, the line feelers being manually removable and rotatable for replacement and for rotational orientation within the stub means 66. This is accomplished by providing a frictional fit between the line feelers 64 and the stub means 66, preferably hollow tubular stubs integral with the feeler hub 62. The line feelers 64 preferably have curved-over distal ends 64A so as to better recover their normal positions with respect to the grading line 20 upon encountering an obstacle 40 which forces the line feeler 64 away from the grading line 20.

Finally, a bias means 70 is engaged with the feeler assembly 60 and with the bracket 50 for urging the feeler hub 62 toward a preferred rotational position relative to the bracket 50 so that with the invention extending to one side of the extruder, one of the pair of line feelers 64' extends into contact with the grading line 20 as shown in FIG. 1. When the feeler 64' reaches a position, along the grading line 20, where the grade is increased or decreased, or where a greater flow rate of concrete is required, the slope of the grading line 20 changes accordingly and the line feeler followers it, which then causes the sensor arm 10B to rotate, which, in turn causes the grade sensor to signal the servomechanisms to make the appropriate process changes. The bias means 70 is preferably a coil spring 72, one end of the spring being fastened to the bracket 50, the other end being fastened within the tubular stub means 66, the coil spring 72 and the one line feeler 64' being approximately colinearly aligned. The other of the pair of line feelers 64" is preferably directed in the direction of travel, "A" in FIG. 1.

When feeler 64' encounters an obstruction such as stake 40 as shown in FIG. 2, the hub 62 is forced to rotate so that the line feeler 64" moves into contact with the grading line 20 before line feeler 64' looses contact with the grading line 20. The bias means 70 forces the feeler hub 62 to rotate line feeler 64' again, into contact with the grading line 20 when the obstruction has been passed so that the grade follower 30B is able to follow the grading line 20 around obstacles without causing a discontinuity or stoppage in the concrete pouring operation. The bending over of the distal ends 64A is considered an important and highly advantageous improvement over the prior art and a step of novelty in the present invention. It has been shown in practice that the recovery of the feelers 64 once they loose contact with line 20, is highly dependent upon this feature.

The nuts 54B and 54C on bolt 54A enable the mounting of hub 62 so that it is able to rotate freely about bolt 54A. The nuts 54B and 54C on bolt 56A enable tightening of the connection between bracket portions 50A and 50B such that rotation of hub 62 will not cause movement between portions 50A and 50B, while a side force on portion 50A will cause rotation of portion 50A about bolt 56A thereby preventing damage to the invention by such force.

While the invention has been described with reference to at least one preferred embodiment, it is to be clearly understood by those skilled in the art that the invention is not limited thereto. Rather, the scope of the invention is to be interpreted only in conjunction with the appended claims.

What is claimed is:

1. A grade follower device for use with a moving equipment, a grade sensor, a grading line and a feeler obstruction, the device comprising:

a bracket providing a bracket mounting means at a proximal end thereof for attachment of the device to the grade sensor, and a hub mounting means at a distal end thereof, a feeler assembly providing:

a feeler hub rotationally engaged on the hub mounting means and a pair of line feelers secured in radial positions on the feeler hub at an acute angle therebetween;

a bias means engaged with the feeler hub and with the bracket for urging the feeler hub toward a preferred rotational position so that with the device extending from the moving equipment, with one of the pair of line feelers running in contact with the grading line, the feeler obstruction forcing hub the feeler to rotate the one line feeler out of contact with the grading line while rotating other line feeler into contact therewith, the bias means forcing the feeler hub to rotate the one line feeler, again, into contact with the grading line when the obstruction has been passed, whereby the grade sensor is able to follow the grading line without a discontinuity while the feeler assembly passes the feeler obstruction;

feelers, the line feelers being manually removable and rotatable therein for replacement and for rotational orientation therein.

2. The device of claim 1 wherein the bracket provides a means for rotation of the bracket about the bracket mounting means when acted upon by a force greater than a force of a selected magnitude.

3. The device of claim 1 wherein the bias means is a coil spring, one end of the spring being fastened to the bracket, the other end being fastened to the feeler hub, the coil spring and the one line feeler being colinearly aligned.

4. A grade follower device for use with a moving equipment, a grading line and a feeler obstruction, the device comprising:

a grade sensor having a sensor arm;

a bracket providing a bracket mounting means at a proximal end thereof for attachment of the device to the sensor arm, and a hub mounting means at a distal end thereof;

a feeler assembly providing:

a feeler hub rotationally engaged on the hub mounting means and a pair of line feelers secured in radial positions on the feeler hub at an acute angle therebetween;

a bias means engaged with the feeler hub and with the bracket for urging the feeler hub toward a preferred rotational position so that with the device extending from the moving equipment, with one of the pair of line feelers running in contact with the grading line, the feeler obstruction forcing the hub to rotate the one line feeler out of contact with the grading line while rotating other line feeler into contact therewith, the bias means forcing the feeler hub to rotate the one line feeler, again, into contact with the grading line when the feeler obstruction has been passed, whereby the grade sensor is able to follow the grading line without a discontinuity while the feeler assembly passes the feeler obstruction;

the bracket providing a means for rotation of the bracket about the bracket mounting means when acted upon by a force greater than a force of a selected magnitude.

5. The device of claim 4 wherein the feeler hub provides hollow tubular stub means for frictionally mounting the line feelers, the line feelers being manually removable and rotatable therein for replacement and for rotational orientation therein.

6. The device of claim 4 wherein the bias means is a coil spring, one end of spring being fastened to the bracket, the other end being fastened to the feeler hub, the coil spring and the one line feeler being colinearly aligned.

* * * * *